US005150965A

United States Patent [19]

Fox

[11] Patent Number: 5,150,965

[45] Date of Patent: Sep. 29, 1992

[54] RADIATION-EMITTING PANELS AND DISPLAY ASSEMBLIES

[75] Inventor: Neil A. Fox, Eversham, England

[73] Assignee: Smiths Industries Public Limited Company, London, England

[21] Appl. No.: 726,176

[22] Filed: Jul. 5, 1991

[30] Foreign Application Priority Data

Jul. 16, 1990 [GB] United Kingdom ..... 9015575

[51] Int. Cl.[5] ..... F21K 7/00

[52] U.S. Cl. ..... 362/260; 362/29; 362/97; 362/225; 313/1; 313/113; 313/493; 313/610; 313/634

[58] Field of Search ..... 362/29, 33, 97, 224, 362/225, 235, 255, 260; 313/582, 422, 493, 113, 610, 634, 1

[56] References Cited

U.S. PATENT DOCUMENTS 4,835,444 5/1989 Goudy, Jr. ..... 313/634

5,051,164 9/1991 Misono et al. ..... 313/493 X

*Primary Examiner*—Stephen F. Husar

*Attorney, Agent, or Firm*—Pollock, VandeSande and Priddy

[57] ABSTRACT

A radiation-emitting panel such as for back lighting a display has three transparent glass plates sealed together around their edges to form two gas-discharge volumes. The plates are supported within their edges by two identical arrays of pillars formed integrally from the plates. The lower surface of the lower plate is profiled with inverted frusto-pyramids and coated with a reflecting layer. Electrodes normally cause discharge within the upper volume, and the emission of light. Electrodes can be used to excite the lower volume, such as on failure of the upper volume, the reflector acting to reflect light preferentially into the pillars.

10 Claims, 3 Drawing Sheets

RADIATION-EMITTING PANELS AND DISPLAY ASSEMBLIES

BACKGROUND OF THE INVENTION

This invention relates to radiation-emitting panels and display assemblies.

In many applications, it is desired to be able to produce even illumination over a large area, such as when back lighting instruments. Preferably, the illumination is of high intensity with a low power and heat dissipation whilst being compact and of light weight.

Fluorescent lighting, in which light is generated by photo-ionisation of a phosphor layer in a gas-discharge tube, is ideally suited to this, as far as the level of illumination and power dissipation is concerned. Where even illumination is required over a large area, however, it is necessary either to use several fluorescent tubes in parallel with one another or to use a tube that is bent, in an attempt to produce an even distribution of light. In WO 87/04562 there is described a display in which an arrangement of parallel tubes is reproduced in a flat panel by means of walls that divide the panel into separate discharge paths, each having their own electrode. A bent tube arrangement is similarly reproduced by walls defining a circuitous path between two electrodes. It is usually also necessary to use some form of diffuser in front of such arrangements to produce a more even illumination. This does still not produce illumination which is distributed sufficiently evenly for some applications because of the presence of the walls.

WO 87/04562 also describes a flat panel fluorescent device formed by two glass plates coated with phosphor on their facing surfaces. The plates are spaced from one another and sealed around their edges, the space between the plates being evacuated to a low pressure. Electrodes extend along opposite edges inside the space between the plates, so that discharge can be produced between them. The problem with this construction is that, because of the reduced pressure within the device the plates must be relatively thick to be able to withstand the pressure differential across them. This leads to a device which is relatively heavy and bulky.

Proposals for supporting the opposite plates of the panel by internal structures have been described in J58-46568, GB 2217905, EP 0283014 and PCT/GB90/00075.

Although flat panel lamps are generally more robust than those involving fluorescent tubes, they do suffer from the disadvantage that if the lamp does fail, all illumination is lost. By contrast, where the lamp includes several fluorescent tubes, failure of one tube will only result in a reduction in the level of illumination and uneven illumination. Where the lamp is used to illuminate an instrumentation display, this uneven illumination can, however, be so severe as to make the display illegible in parts. In some applications, such as in aircraft instrumentation displays, it is of great importance that the lamp have some redundancy or a back-up be provided so that adequate illumination is provided on failure of the main lamp. The back-up lamp should also produce illumination that is sufficiently even to render the display legible.

BRIEF SUMMARY OF THE INVENTION

It is an object of the present invention to provide a radiation-emitting panel with redundancy by which even illumination can be achieved.

According to one aspect of the present invention there is provided a radiation-emitting panel including a first upper plate transparent to visible radiation, a second intermediate plate sealed with the first plate around its edge and enclosing a first gas-discharge volume at reduced pressure between the lower surface of the first plate and the upper surface of the second plate, a third lower plate sealed with the second plate around its edge and enclosing a second gas-discharge volume at reduced pressure between the lower surface of the second plate and the upper surface of the third plate, electrodes operable to excite discharge and radiation within said gas-discharge volumes, the plates being supported within their edges by at least one respective support member internally of the first and second gas-discharge volumes, and the second plate being transparent to visible radiation such that a part of least of the radiation produced in the second gas-discharge volume is transmitted through the second and first plates such that illumination can be provided by the panel even when there is no discharge within the first gas-discharge volume.

The support members are preferably of a radiation-transmitting material and may be provided by arrays of pillars extending between the first and second plate and between the second and third plate. The pillars may be spaced from one another by flat regions on the surface of the plates, there being a phosphor coating within both the first and second gas-discharge volumes, and the flat regions on the second plate having no phosphor coating or a thinner phosphor coating than other surfaces within the first and second gas-discharge volumes so that radiation can pass more freely through these flat regions. The array of pillars extending between the first and second plate is preferably identical with the array of pillars extending between the second and third plate. The pillars may be of square section and have inclined sides.

The second plate may have pillars formed integrally with the plate on opposite sides. The second plate is preferably of a material transparent to ultra-violet radiation. The three plates are preferably of the same material. The third plate is preferably transparent to visible radiation, the panel including a reflector adjacent the outer surface of the third plate arranged to reflect radiation into the panel. The reflector is preferably shaped to reflect radiation preferentially into the support members and may be shaped with an array of inverted frusto-pyramids. The electrodes may be unheated.

According to another aspect of the present invention there is provided a display assembly including a display and a radiation-emitting panel according to the above one aspect of the invention. The display may be a liquid crystal display. The assembly may include power supply means arranged in normal operation to supply power to the electrodes such as to cause discharge of only the first gas-discharge volume, the power supply means being responsive to failure of discharge within the first gas-discharge volume instead to cause discharge of the second gas-discharge volume.

A light-emitting panel and a display assembly including such a panel, according to the present invention, will now be described, by way of example, with reference to the accompanying drawings.

Figure 1:
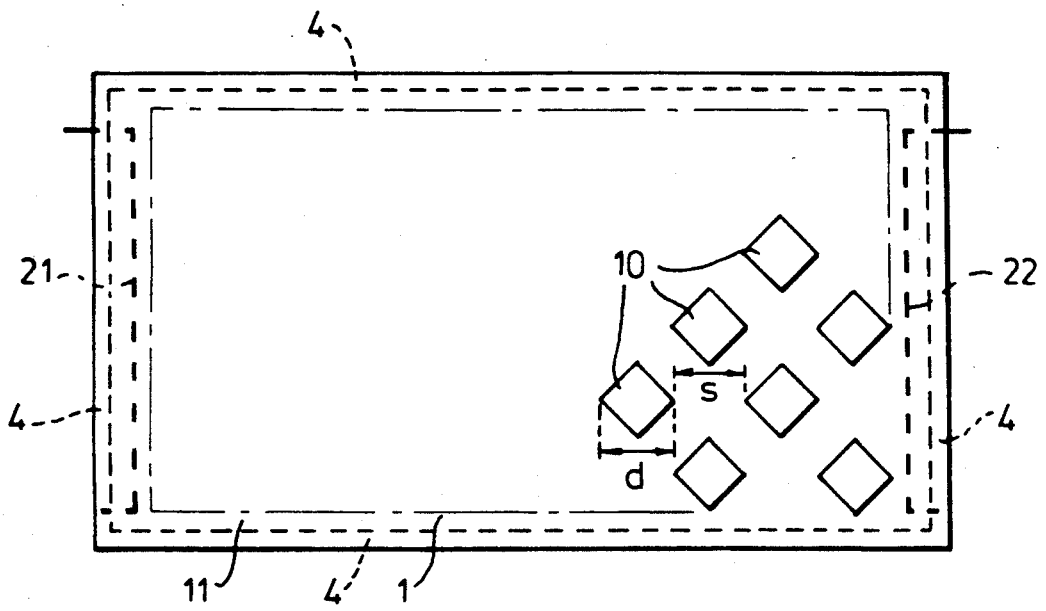
FIG. 1 is a plan view of the panel from above.

The light-emitting panel or lamp comprises three flat, parallel rectangular glass plates 1 to 3 which are each transparent to light, that is, visible radiation. Electrically-insulative spacers 4, which may be formed by glass bars, are interposed between the plates 1 and 2 and the plates 2 and 3 around their edges to separate them from one another and to form a gas-tight seal between them.

The space between the lower surface 5 of the upper plate 1 and the upper surface 6 of the intermediate plate 2 provides a first gas-discharge volume 7 and is filled with a mixture of argon gas and mercury vapour or other gases and gas mixtures at low pressure. Similarly, the space between the lower surface 8 of the intermediate plate 2 and the upper surface 9 of the lower plate 3 provides a second gas-discharge volume 7' and is filled with the same gas at low pressure.

The lower surface 5 of the upper plate 1 and the upper surface 6 of the intermediate plate 2 are interrupted by an array of pillars 10. The pillars 10 are of square section and frusto-pyramidal shape so that each pillar has four flat angled faces around it. The width of each pillar is typically 0.707 mm giving a diagonal diameter of 1 mm at their base, with a wall angle $\theta$ of 60 degrees to the horizontal and a height of 0.433 mm. The pillars are arranged in straight rows, horizontal in FIG. 1, with spacings between adjacent pillars in a row equal to the base diameter of the pillars. The sides of the pillars 10 are inclined at about 45 degrees to the edges of the panel. Pillars 10 in adjacent rows are staggered from one another by a distance equal to the diameter of the pillars, so that the pillars 10 of one row are aligned midway between pillars of an adjacent row. The edges of adjacent rows are contiguous so that there is no space between adjacent rows.

Figure 1A:
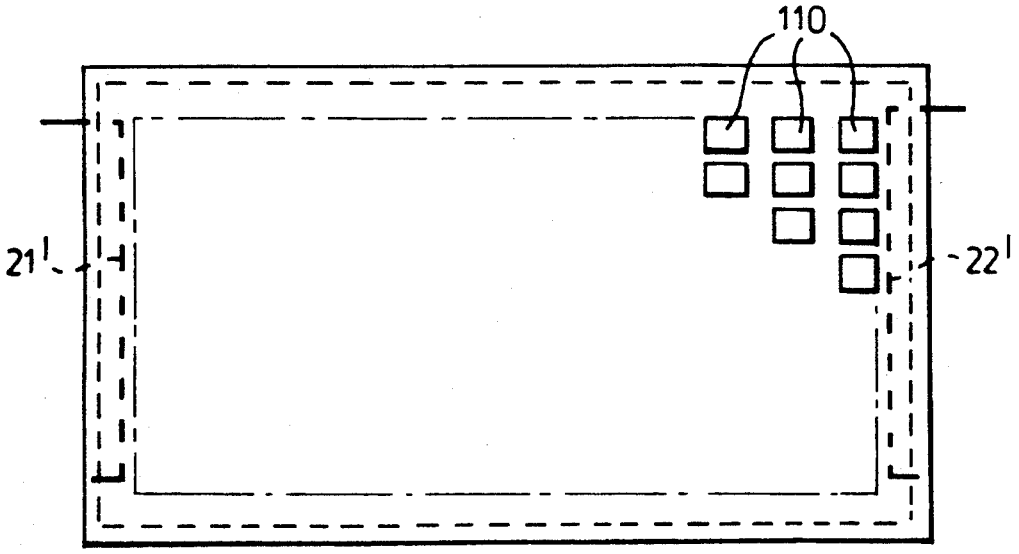
FIG. 1A is a plan view of an alternative panel.
Figure 2:
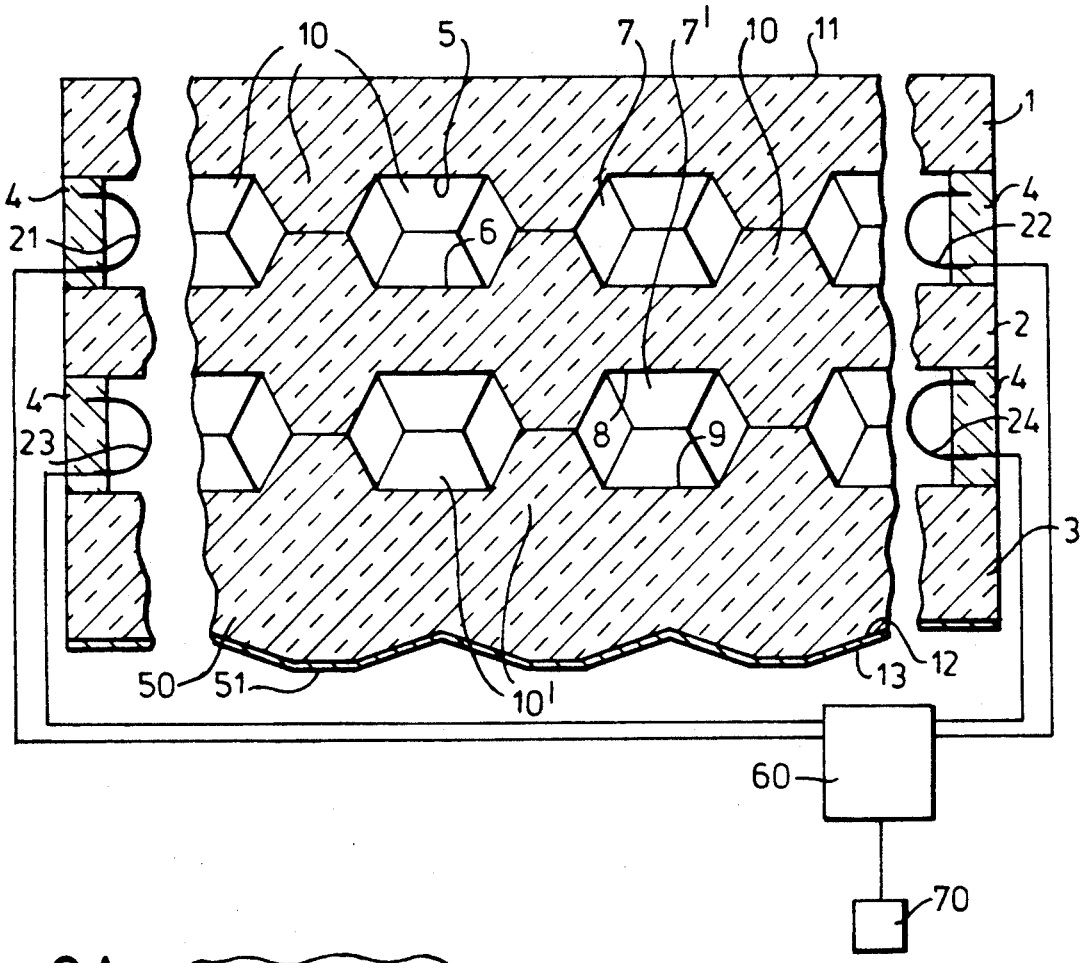
FIG. 2 is a cross-sectional side elevation view of the panel to an enlarged scale.
Figure 2A:
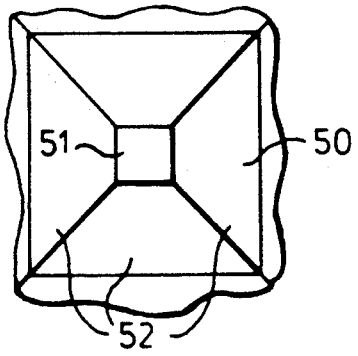
FIG. 2A is a view of a part of the panel from underneath.

An alternative arrangement of the pillars 110 is shown in FIG. 1A in which they are arranged in an orthogonal array of rows and columns parallel with the electrodes 21' and 22' and the edges of the plates extending between the pillars. The sides of the pillars 10 extend parallel to the edges of the panel. In this arrangement there are parallel pathways between the two electrodes 21' and 22' between the rows of pillars 110.

The array of pillars 10 on the two plates 1 and 2 are identical, so that the top of each pillar on one plate is aligned with, and contacts, the top of a corresponding pillar on the opposite plate. The abutting top surfaces of the pillars 10 on the two plates are joined, such as, for example by an adhesive having a refractive index matched to that of the glass forming the plates 1 and 2. The spacing between the two plates is, therefore, equal to the sum of the height of the pillars on the two plates.

The lower surface 8 of the intermediate plate 2 and the upper surface 9 of the lower plate 3 are similarly interrupted with an array of pillars 10' that are aligned with the pillars 10.

Along opposite vertical sides, inside both gas-discharge volumes 7 and 7', are mounted two pairs of electrodes 21 and 22, and 23 and 24 respectively which are sealed into the spacers 4 and have an electrical conductor extending out through the spacer by which a voltage can be applied. Each electrode 21 to 24 extends along substantially the entire length of one side of the panel, at right angles to, and across the ends of all the rows of pillars 10. The electrodes 21 to 24 are preferably unheated so that the panel forms two separate gas-discharge devices of the cold-cathode kind. In alternative arrangements, a hot-cathode electrode configuration could be used. The electrodes could be formed by a thick, conductive coating on the spacers 4.

The walls of the pillars 10 and 10', the flat, lower surface 5 of the upper plate 1, and the flat, upper surface 9 of the lower surface are coated, such as by a dipping technique, with one or more layers 30 (FIG. 3) of phosphor which emits the desired radiation spectrum when caused to fluoresce by ultra violet radiation in a gas-discharge. The flat upper and lower surface 6 and 8 of the intermediate plate 2 is preferably uncoated with phosphor or only thinly coated to a thickness less than the optimum for the conversion of ultra violet into visible radiation that is, thinner than the coating on the inclined walls of the pillars 10 and 10'. In this way, the maximum amount of radiation produced in the lower gas discharge volume 7' will pass through the intermediate plate 2.

The outer, upper surface 11 of the upper plate 1 is flat and plane; the outer, lower surface 12 of the lower plate 3 is profiled and is coated with a reflective layer 13. The lower surface 12 is cut in such a way that radiation incident on the reflective layer 13 will be reflected preferentially into the pillars 10' rather than onto the flat regions of the surface 9. More particularly, the lower surface is cut to form an array of inverted shallow frusto-pyramids 50 of square base which are aligned with the pillars 10' so that the flat top 51 of each pyramid is aligned with the centre of each pillar. Typically, the flat top 51 of the pyramid 50 is the same size as the top of the pillars 10' and the wall angle $\alpha$ is about 18 degrees, with a lower plate 3 that is 2 mm thick. The edge of one pyramid 50 abuts the edge of the adjacent pyramid on each of its four sides. It can be seen, therefore, that the base of the pyramids 50 is larger than that of the pillars 10 and that the sloping walls 52 of each pyramid are angled towards the overlying pillar.

The panel is mounted beneath an aircraft instrument display 40 (FIG. 3), such as incorporating a liquid crystal matrix display. The electrodes 21 to 24 are each connected to a power supply unit 60 which is normally arranged to apply a high voltage between only the two electrodes 21 and 22 and not the electrodes 23 and 24. In this way, a discharge is produced only in the first volume 7. The power supply unit 60, however, monitors operation of the discharge in the first volume 7 and, if it detects a malfunction of this discharge, it automatically disconnects the electrodes 21 and 22 from the supply and instead applies a discharge voltage across the electrodes 23 and 24 in the second discharge volume 7'. A manual switch 70 may also be provided to enable the user to connect the power supply across either one or both of the pairs of electrodes. In this way, if the discharge between the upper two plates 1 and 2 should fail, the lamp has redundancy in that illumination can be produced from discharge between the lower two plates 2 and 3.

Figure 3:
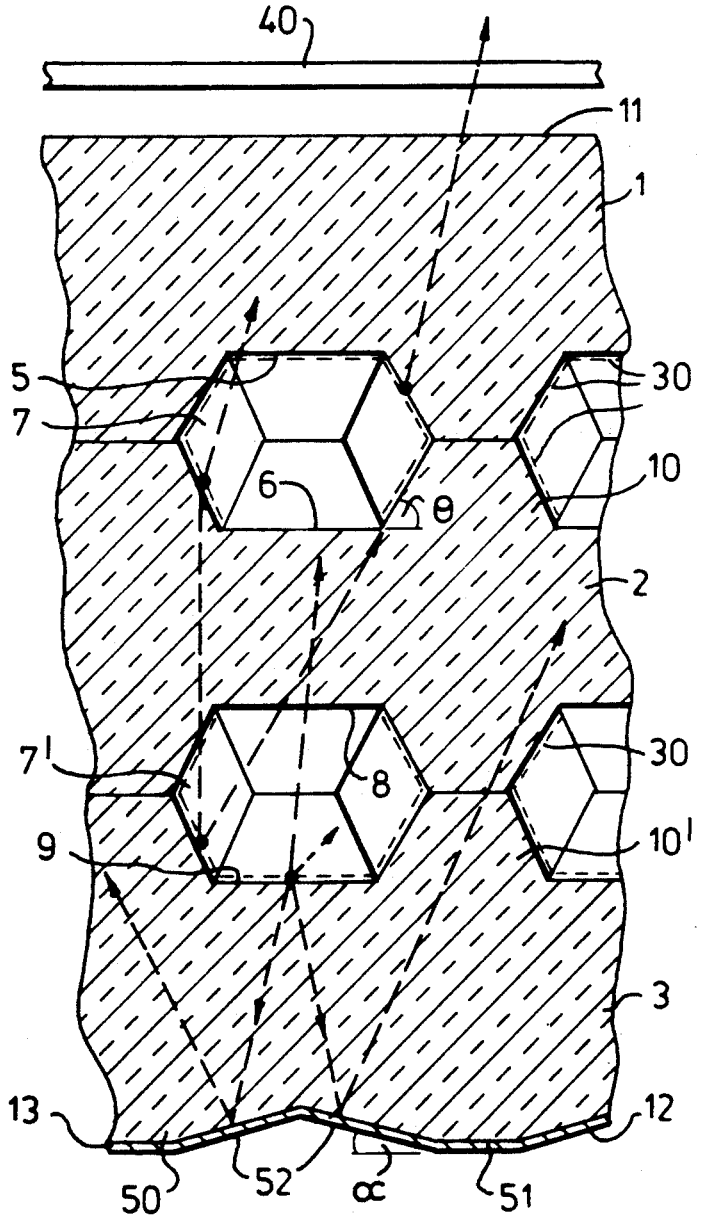
FIG. 3 is an enlarged sectional view of a display assembly including the panel and illustrating ray paths within the panel.

The voltage applied between the electrodes 21 and 22 or 23 and 24 is sufficient to cause discharge within the panel which in turn causes fluorescence of the phosphor layer 30. Discharge between the electrodes results in production of a plasma that is unconfined by any internal barriers within the panel and that is therefore uniformly distributed within the panel around the pillars 10. Light emitted from the phosphor layer 30 travels both into the gas discharge volume 7 or 7' and into the glass material supporting the phosphor layer, as illustrated in FIG. 3. The sloping walls of the pillars 10 cause any light entering the pillars to be eventually reflected towards the opposite surface of the respective plate. In this respect, it is preferable that the walls or sides of the pillars are inclined, that is, for the angle where they meet the surface of the plate, to be less than 90 degrees.

Light passing into the upper plate 1 will emerge from the upper surface 11 and will backlight the overlying display 40. Some of the light caused by discharge in the volume 7 will enter the intermediate plate 2. A proportion of this light will be specularly reflected by any phosphor layer 30 on the lower surface 8 of the intermediate plate 2 in a generally upward direction, towards the upper plate 1. Some of the light will pass through the phosphor layer 30 and enter the lower plate 3. Some light will also enter the lower plate 3 directly via the pillars 10 and 10'.

Light incident on the lower surface 12 of the lower plate 3 will be reflected by the layer 13 preferentially towards the pillars 10' rather than towards the flat regions of the surface 9 around the pillars. For example, any light generated by emission from phosphor in the flat regions of the surface 9 which travels vertically downwards through the thickness of the lower plate 2, will be incident on one of the sloping walls 52 of one of the pyramids 50. The light will be reflected upwardly, at an angle of 36 degrees to the vertical, towards the closest one of the pillars 10'. In general, light will be incident at many different angles and not all of the light will be reflected towards the pillars. The proportion that is reflected towards the pillars will, however, be greater than is produced by a plane reflecting surface. The amount of light which is reflected by the layer 13 onto the flat regions of the surface 8 between the pillars 10' is, therefore, less than would be produced by plane reflecting layer. The pillars 10 and 10' act as light guides which enable a significant proportion of the light reflected by the layer 13 to pass directly into the upper plate 1. This is an advantage because the performance of phosphors is reduced in conditions of high illumination.

The increased level of radiation passing into the pillars 10 may increase the illumination of the phosphor coating on the pillars and thereby reduce its effectiveness. This is not important, however, because, when viewed from above, only a relatively small contribution is made by radiation from the walls of the pillars 10 compared with that from the flat surface between the pillars.

The pillars 10 on the plate 1, 2 and 3 and the pyramidal reflecting surface 12 could be made by any conventional technique such as by chemical etching, glass moulding, mechanical or ion machining or by laser ablation techniques.

The arrangement of the present invention by which a single intermediate plate defines both the lower surface of the upper discharge volume and the upper surface of the lower discharge volume has several advantages. Firstly, the lamp can be thinner and more compact than an equivalent lamp produced by stacking together two separate flat panel lamps. The efficiency of transmission of light through the intermediate plate is also high because there are no barriers within the plate at which reflection, refraction or absorption might occur. The opposite surfaces of the intermediate plate can be produced highly parallel compared with an equivalent member produced by joining together two plates. This is important for ensuring the maximum efficiency of transmission of radiation along the pillars 10 and 10'. Alignment of the pillars is also facilitated.

Although some of light produced by discharge in the lower volume 7' will be attenuated on passage through the phosphor layer 30 in the upper discharge volume 7, the amount of light emerging from the upper surface 11 of the lamp will be sufficient for back-up illumination purposes. If the intermediate plate 2 is made up from a glass transparent to ultra-violet radiation, it is possible for the ultra-violet radiation generated in one of gas-discharge volumes to excite the phosphor coating in the other gas-discharge volume. This can be used to enhance the amount of visible radiation produced by discharge in the lower volume 7'. Preferably, all three plates 1 to 3 are of the same material but, where the intermediate plate 2 is made of a material different from that of the upper plate 1 and lower plate 3, it should be matched in thermal expansion to the upper and lower plates. The illumination produced will be evenly distributed across the surface of the panel apart from local variations in intensity between regions overlaying the pillars and regions surrounding the pillars.

The intermediate plate need not be formed with integral pillars but could be a flat plate the surfaces of which contact the tops of the pillars on the upper and lower plates.

Lamps of this kind are particularly useful for illumination of displays where redundancy of illumination is required but could also, for example, be used for room illumination where it was important for back-up illumination to be available. It will be appreciated that discharge could be produced in both discharge volumes simultaneously when higher levels of illumination are needed.

What I claim is:

1. A radiation-emitting panel of the kind including a first upper plate transparent to visible radiation, a second plate sealed with the first plate around its edge and enclosing a first gas-discharge volume at reduced pressure between a lower surface of the first plate and an upper surface of the second plate, at least one support member supporting the first and second plates within their edges internally of the first gas-discharge volume, and electrodes operable to excite discharge and radiation within said gas-discharge volume, the improvement wherein the panel includes a third lower plate, means sealing the third plate with the second plate around its edge and enclosing a second gas-discharge volume at reduced pressure between the lower surface of the second plate and the upper surface of the third plate, at least one support member supporting the second and third plates within their edges internally of the second gas-discharge volume, and electrodes operable to excite discharge and radiation within the second gas-discharge volume, and wherein the second plate is transparent to visible radiation such that a part at least of the radiation produced in the second gas-discharge volume is transmitted through the second and first plates such that illumination can be provided by the panel even when there is no discharge within the first gas-discharge volume.

2. A radiation-emitting panel according to claim 1, wherein the support members are of a radiation-transmitting material.

3. A radiation-emitting panel according to claim 1, wherein the support members are provided by two identical arrays of pillars extending between the first and second plate and between the second and third plate.

4. A radiation-emitting panel according to claim 3, wherein the pillars are spaced from one another by flat regions on the surface of the plates, wherein there is a phosphor coating within both the first and second gas-discharge volumes, and wherein the flat regions on the second plate have no phosphor coating or a thinner phosphor coating than other surfaces within the first and second gas-discharge volumes so that radiation can pass more freely through these flat regions.

5. A radiation-emitting panel acccording to claim 3, wherein the second plate has pillars formed integrally with the plate on opposite sides.

6. A radiation-emitting panel according to claim 1, wherein the second plate is of a material transparent to ultra-violet radiation.

7. A radiation-emitting panel according to claim 1, wherein the three plates are of the same material.

8. A radiation-emitting panel according to claim 1, wherein the third plate is transparent to visible radiation, and wherein the panel includes a reflector adjacent a lower surface of the third plate. the reflector being arranged to reflect radiation into the panel.

9. A radiation-emitting panel according to claim 8, wherein the reflector is shaped to reflect radiation preferentially into the suport members.

10. A radiation-emitting panel comprising: a first upper plate transparent to visible radiation; a second plate sealed with the first plate around its edge and enclosing a first gas-discharge volume at reduced pressure between a lower surface of the first plate and an upper surface of the of second plate; a first array of radiation-emitting pillars extending between the first and second plates within the first gas-discharge volume; electrodes operable to excite discharge and radiation within said first gas-discharge volume; a third lower plate transparent to visible radiation, the third plate being sealed with the second plate around its edge and enclosing a second gas-discharge volume at reduced pressure between a lower surface of the second plate and an upper surface of the third plate; a second array of radiation-transmitting pillars extending between the second and third plates within the second gas-discharge volume, the second array being identical with the first array; electrodes operable to excite discharge and radiation within the second gas-discharge volume; and a reflector adjacent a lower surface of the third plate such that a part at least of the radiation produced in the second gas-discharge volume is reflected by the reflector and transmitted through the second and first plates and such that illumination can be provided by the panel even when there is no discharge within the first gas-discharge volume.

* * * * *